United States Patent [19]

Chen

[11] Patent Number: 4,981,032

[45] Date of Patent: Jan. 1, 1991

[54] CRIMPER FOR CRIMPING ELECTRIC TERMINALS

[75] Inventor: Ching-Jen Chen, Panchiao, Taiwan

[73] Assignee: Bleiwerk Goslar GmbH & Co. Kg Besserer & Ernst, Goslar, Fed. Rep. of Germany

[21] Appl. No.: 456,358

[22] Filed: Dec. 26, 1989

[51] Int. Cl.[5] ..... B21D 7/06; H01R 43/042

[52] U.S. Cl. ..... 72/410; 29/751; 7/107

[58] Field of Search ..... 72/410, 409, 416; 29/751; 7/107; 81/418, 421, 424.5, 426.5

[56] References Cited

U.S. PATENT DOCUMENTS

| | | | |
|---|---|---|---|
| 2,992,576 | 7/1961 | Evans | 72/410 |
| 3,205,568 | 9/1965 | Stull | 72/410 |
| 4,561,282 | 12/1985 | Hadden | 72/410 |
| 4,713,874 | 12/1987 | Schwartz | 29/751 |

FOREIGN PATENT DOCUMENTS

| | | | |
|---|---|---|---|
| 565874 | 8/1957 | Italy | 72/410 |
| 946393 | 1/1964 | United Kingdom | 72/410 |

*Primary Examiner*—Daniel C. Crane

*Attorney, Agent, or Firm*—Herbert Dubno Andrew Wilford

[57] ABSTRACT

A crimper for crimping terminals of electrical conductors includes upper and lower elongated members pivoted to one another and having rear handle portions. A first crimping component is provided anterior to the pivot point of the elongated members and includes a first press member formed on the lower elongated member and a first stepped recess formed on the upper elongated member. A second crimping compenent is provided posterior to the pivot point and includes a second press member and a second stepped recess respectively formed on the upper and lower elongated members. Both first and second press members are attached pivotally to the lower and upper elongated member so that the press members can be guided easily into the stepped recesses to effect crimping operations.

3 Claims, 4 Drawing Sheets

CRIMPER FOR CRIMPING ELECTRIC TERMINALS

BACKGROUND OF THE INVENTION

This invention relates to a crimper for crimping electric terminals, and particularly to a crimper having two jaw pieces with stepped recesses of different dimensions to hold terminals of different conductors as well as having two pivoted press members to enter the stepped recesses to crimp the terminals put in the stepped recesses.

A conventional crimper for crimping electric terminals is shown in FIG. 1, wherein two elongated member 92 and 93 are pivoted together by means of a pivot bolt 94, and a jaw piece having a stepped recess therein is attached to one of the elongated member 92 to cooperate with a press member which is attached immovably to the other elongated member 93. When the handle members of the elongated members 92, 93 are pressed against one another, the press member is moved into the recess of the jaw piece and crimped on the electrical terminal which is placed in the recess. In common practice, the stepped recess of such a crimper is arranged to be wider than the press member because the press member moves along a curve path rather than straight into the stepped recess of the jaw member, so that the stepped recess is also larger than the terminal of a conductor. Therefore, the conductor terminal put in the stepped recess is liable to deviate from a proper position and the terminal crimped thereby may deviate from the desired quality.

Cables used for the wiring of telephones are of different specifications, such as those having six pieces of wire, eight pieces of wire and twelve pieces of wire. Such cables require individual conventional crimpers with different sizes of stepped recesses since the conventional crimpers include a single stepped recess for receiving a terminal and no selectivity can be acquired for the stepped recess.

SUMMARY OF THE INVENTION

An object of the invention is to provide a crimper for crimping terminals of electrical conductors which eliminates the need to make the stepped recess thereof much larger than the press member so that the stepped recess is in close fit with the terminals of the conductors.

Another object of the invention is to provide a crimper of the type described above with more than one stepped recess for receiving terminals of electrical conductors so that a selectivity for the stepped recess is available.

According to the present invention, a crimper for crimping electric terminals comprises: a one piece upper elongated member having a first handle portion, a first arm portion and a first forked head portion extending forward from the first arm portion and projecting downward; the first forked head portion having two parallel first jaw plate members extending forward from a lower portion of the first forked head portion, and a first jaw piece provided between the jaw plate members, the first jaw piece and the first jaw plate members cooperatively having a first stepped recess means; a one piece lower elongated member having a second handle portion, a second arm portion and a second forked head portion extending forward from the second arm portion and projecting upward, the second forked head portion being pivoted to the first forked head portion; the second forked head portion having two parallel second jaw plate members extending forward from an upper portion of the second forked head portion, a first press member pivoted to the parallel second jaw plate members, and a first pivot pin for pivotally connecting the first press member and the second jaw plate members, the first press member having an oblong pivot hole to permit the first pivot pin to pass therethrough, the first pivot pin being laterally movable in the oblong pivot hole, the first press member and the first stepped recess means forming a first crimping component.

In one aspect of the invention, the first arm portion further has a second press member pivoted thereto and a second pivot pin to pivotally connect the second press member to the first arm portion, the second press member having a second oblong pivot hole to permit the second pivot pin to pass therethrough, the second arm portion having a second jaw piece attached thereto, the second jaw piece having a second stepped recess for receiving the second press member, the second press member and the second stepped recess means forming a second crimping component.

The present exemplary preferred embodiment will be described in detail with reference to the accompanying drawings, in which:

DETAILED DESCRIPTION OF THE PREFERRED EMBODIMENT

Figure 1:
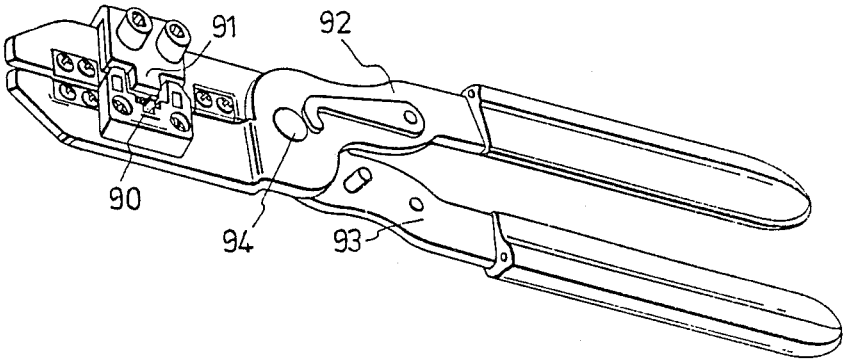
PRIOR ART FIG. 1
FIG. 1 is a perspective view of a crimper in the prior art.
Figure 2:
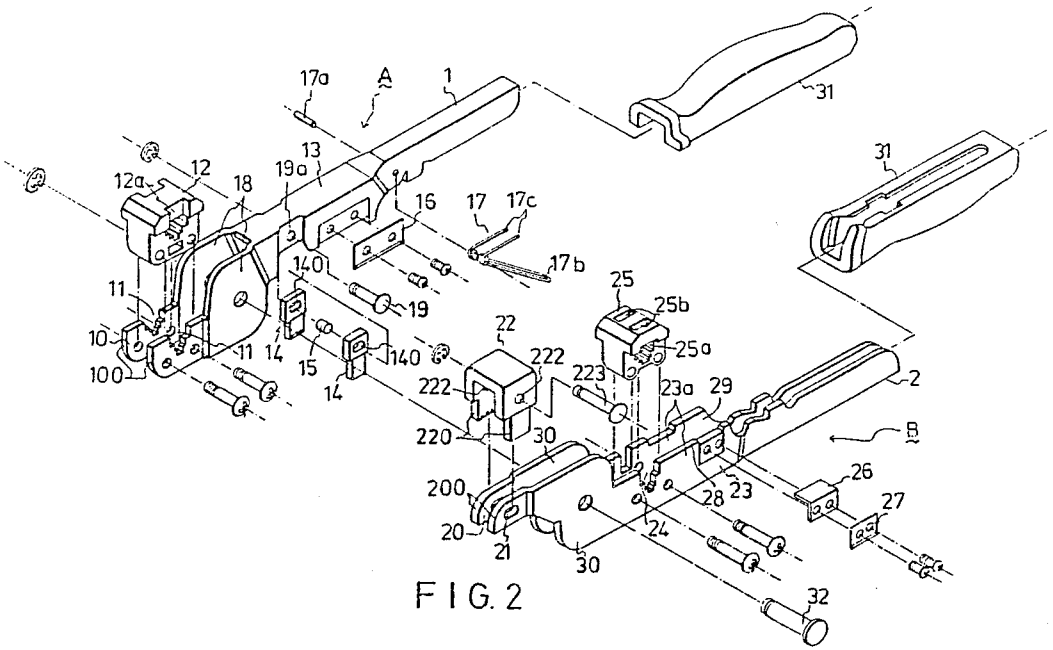
FIG. 2 is an exploded view of a crimper embodying the present invention.
Figure 3:
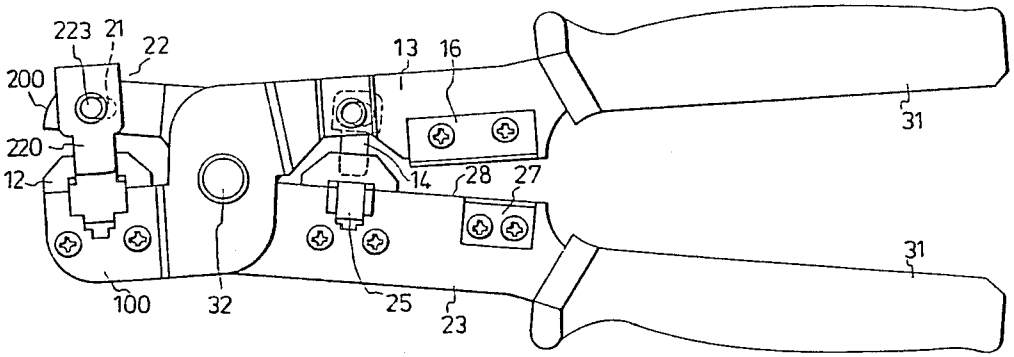
FIG. 3 is a plan view of the crimper of FIG. 2.
Figure 4:
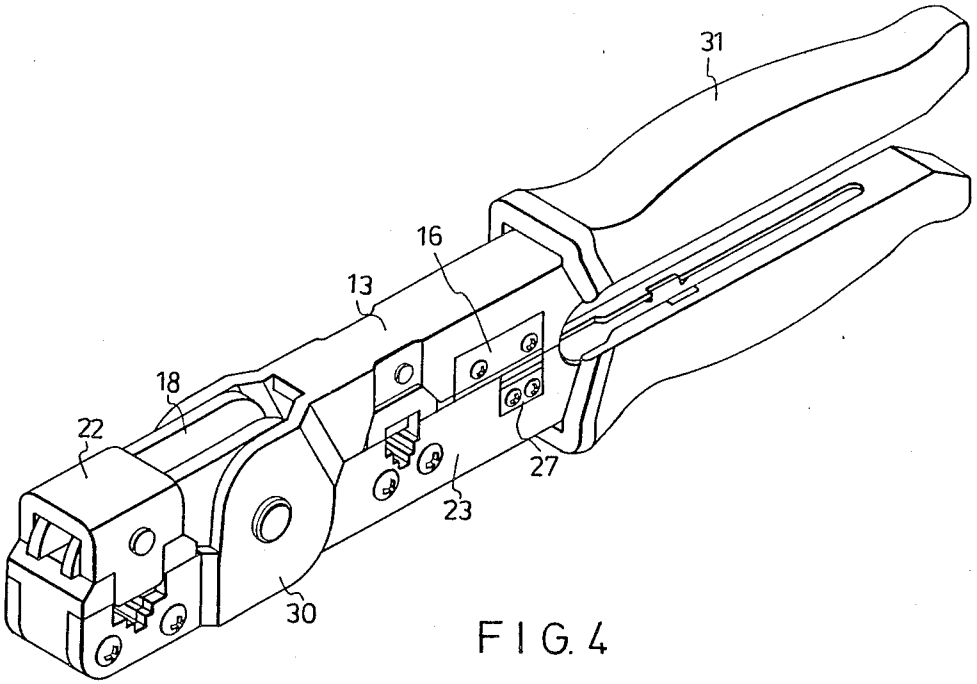
FIG. 4 is a perspective view of the crimper of FIG. 2.

Referring to FIGS. 2, 3 and 4, a crimper according to the present invention is shown, including an upper and a lower elongated member A and B. The upper elongated member A includes a first handle portion 1, a first arm portion 13 of U-shaped cross-section, a first forked head 10. The forked head 10 includes two parallel plate members 18 which extend forward from the first arm portion 13 and project downward relative to the longitudinal axis of the first elongated member A. Two jaw plate members 100 extend respectively forward from the lower side of the parallel plate members l8*a*. Each of the jaw plate members 100 is provided with a stepped notch 11. A jaw piece 12 is provided between and secured to the jaw plate members 100. A stepped recess l2*a* having the same indented profile as the stepped notches 11 is provided in the jaw piece 12 in alignment with the notches 11 so as to cooperate therewith.

The first arm portion 13 has a restricted portion to which are attached two first press pieces 14 on the two sides thereof by means of a pivot pin 19 which passes through a pivot hole l9*a*. The pivot pin 19 incorporates a sleeve 15 which is placed between the press pieces 14, and passes through two oblong openings 140 of the press pieces 14 so that the press pieces 14 can move within a certain limited range. A cutting blade 15 is also attached to the first arm portion 13 posterior to the press pieces 14.

The lower elongated member B includes a second handle portion 2, a second arm portion 23 and a second forked head portion 20. The second forked head portion 20 includes two parallel plate members 30 which extend forward from the second arm portion 23 and project upward relative to the longitudinal line of the lower elongated member B. Two jaw plate members 200 extend respectively forward from the upper portions of the parallel plate members 30. Each of the jaw plate members 200 is provided with a hole 21. An inverted U-shaped member 22 is placed across and ride on the jaw plate members 200. The inverted U-shaped member 22 includes two press arms 220 extending downward on two sides of the jaw plate members 200. Each press arm 220 is provided with an oblong hole 222. A pivot pin 223 passes through the oblong holes 223 of the jaw plate members 200 and the holes 222 of the press arms 220. The press arms 220 are also movable within a certain limited range as the press pieces 14.

The parallel plate members 30 of the second forked head portion 20 are pivoted to the parallel plate members 18 of the first forked head portion 10 by means of a pivot bolt 32. The second arm portion 23 is of U-shaped cross-section and includes two parallel plate members 23*a* which are provided respectively with stepped notches 24 and which sandwiches a second jaw piece 25. The jaw piece 25 is provided with a stepped recess 25*a* to be aligned with the stepped notches 24. A second cutting blade 27 and a seat 26 are attached to one of the plates 23*a* of the arm portion 23 posterior to the notches 24.

Grip members 31 are respectively attached to the first and second handle portion 1 and 2. A torsion spring 17 is attached to the first handle portion 1 by means of a pin 17*a*. The spring 17 has two ends 17*c* engaged with the first handle portion 1 and an intermediate portion 17*b* engaged with the second handle portion 2, thereby pushing away the handle portions 1 and 2 from one another.

It can be seen that the stepped notches 11, the stepped recess 12*a* of the first jaw piece 12 and the press arms 220 cooperatively form a first crimping component, and the stepped notches 24, the stepped recess 25*a* of the jaw piece 25 and the press pieces 14 cooperatively form a second crimping component. The stepped notches 24 and the stepped recess 25*a* of the second elongated member 2 are dimensioned differently from the stepped notches 11 and the stepped recess 12*a* so that the stepped notches 24 and the stepped recess 25*a* can receive an electrical terminal different in size from that to be received in the stepped notches 11 and stepped recess 12*a*. The user may select any one of the first and second crimping components for his desired electrical conductor.

In operation, the first and second handle portions 1, 2 are squeezed so that the handle portions are moved against the action of the spring 17. In this situation, the first and second jaw plate members 100 and 200 approach one another, and the press arms 220 of the U-shaped member 22 are moved into the stepped recesses 11 of the jaw piece 12. Since the U-shaped member 22 is movable relative to the jaw plate members 200, the press arms 220 thereof are easily guided into the stepped recess 11 although the stepped recess 11 are not broadened relative to the press arms 220.

While the press arms 220 enter in the stepped recess 11, the press pieces 14 also enter in the stepped recesses 25*a* of the jaw piece 25 through openings 25*b*.

The crimper of the invention can also be used for stripping and cutting electrical conductors. In stripping a conductor, the conductor is put between the cutting blades 16 and 27. The cutting blades 16 and 27 do not abut with one another when the handle portions 1,2 are squeezed because of the presence of a stop projection 29 formed on the arm portion 23. Graduation marks may be provided on the upper face of the cutting blade seat 26 to measure the length of the conductor to be stripped. When a conductor is to be cut, the conductor can be put between the cutting blade 16 and a bearing edge face 28 of the arm portion 23.

With the invention thus explained, it is apparent that various modifications and variations can be made without departing from the scope of the invention. It is therefore intended that the invention be limited only as indicated in the appended claims.

What I claim is:

1. A crimper for crimping electric terminals comprising a one piece upper elongated member having a first handle portion, a first arm portion and a first forked head portion extending forward from said first arm portion and projecting downward.

said first forked head portion having two parallel first jaw plate members extending forwardly from a lower portion of said first forked head portion, and a first jaw piece provided between said jaw plate members, said first jaw piece and said first jaw plate members cooperatively having a first stepped recess means, a one piece lower elongated member having a second handle portion, a second arm portion and a second forked head portion extending forward from said second arm portion and projecting upward said second forked head portion being pivoted to said first forked head portion, said second forked head portion having two parallel second jaw plate members extending forward from an upper portion of said second forked head portion, a first press member pivoted to said parallel second jaw plate members, and a first pivot pin for pivotally connecting said first press member and said second jaw plate members, said first press member having an oblong pivot hole to permit said first pivot pin to pass therethrough, said first pivot pin being movable laterally in said oblong pivot hole, said first press member and said first stepped recess means forming a first crimping component, said first arm portion having a second press member pivoted thereto and a second pivot pin to connect pivotally said second press member to said first arm portion, said second press member having a second oblong pivot hole to permit said second pivot pin to pass therethrough, said second arm portion having a second jaw piece attached thereto, said second jaw piece having a second stepped recess means for receiving said second press member, and said second press member and said second stepped recess means forming a second crimping component.

2. A crimper as claimed in claim 1, wherein said upper elongated member further has a first cutting blade in said first arm portion, and said lower elongated member further has a second cutting blade in said second arm portion, said first and second cutting blades forming a wire stripping component.

3. A crimper as claimed in claim 2, wherein said lower elongated member further has a bearing edge face in said second arm portion adjacent to said second cutting blade, said first cutting blade being extended longitudinally to a portion opposite to said bearing edge face, said first cutting blade and said bearing edge face forming a wire cutting component.

* * * * *

UNITED STATES PATENT AND TRADEMARK OFFICE

CERTIFICATE OF CORRECTION

PATENT NO. : 4,981,032

DATED : January 1, 1991

INVENTOR(S) : Ching-Jen Chen

It is certified that error appears in the above-indentified patent and that said Letters Patent is hereby corrected as shown below:

On the title page, please delete "[73] Assignee: Bleiwerk Goslar GmbH & Co. Kg Besserer & Ernst, Goslar, Fed. Rep. of Germany".

On the title page, above the Abstract, "Herbert Dubno Andrew Wilford" should be —Thomas R. Vigil—.

Signed and Sealed this

Twenty-fifth Day of April, 1995

*Attest:*

Bruce Lehman

BRUCE LEHMAN

*Attesting Officer*

*Commissioner of Patents and Trademarks*